US008459512B2

(12) United States Patent
Arvizu

(10) Patent No.: US 8,459,512 B2
(45) Date of Patent: Jun. 11, 2013

(54) RE-SEALABLE SPIGOT FOR A COLLAPSIBLE BEVERAGE CONTAINER

(75) Inventor: Gilbert Arvizu, Rancho Mirage, CA (US)

(73) Assignee: Sports Pouch Beverage Co., Inc., Rancho Mirage, CA (US)

( * ) Notice: Subject to any disclaimer, the term of this patent is extended or adjusted under 35 U.S.C. 154(b) by 376 days.

(21) Appl. No.: 12/178,888

(22) Filed: Jul. 24, 2008

(65) Prior Publication Data

US 2010/0021089 A1 Jan. 28, 2010

(51) Int. Cl.

| | |
|---|---|
| ***B65D 88/54*** | (2006.01) |
| ***B65D 35/00*** | (2006.01) |
| ***B65D 83/00*** | (2006.01) |
| ***G01F 11/04*** | (2006.01) |
| ***B67D 1/00*** | (2006.01) |

(52) U.S. Cl.
USPC ..... 222/525; 222/523; 222/153.14; 222/107; 215/311; 215/387

(58) Field of Classification Search
USPC ..... 222/525, 528, 529, 531, 532, 546, 222/518, 519, 520, 521, 522, 523, 524, 105, 222/107, 562, 559, 182, 153.06, 153.07, 222/153.14; 215/200–364, 387; 383/80, 904, 383/906, 104, 5; 220/270
See application file for complete search history.

(56) References Cited

U.S. PATENT DOCUMENTS

| | | | | | |
|---|---|---|---|---|---|
| 3,071,271 | A | * | 1/1963 | Thomas | 215/224 |
| 3,581,926 | A | * | 6/1971 | Roder | 215/330 |
| 4,524,876 | A | * | 6/1985 | Kusz | 215/224 |
| 4,666,063 | A | * | 5/1987 | Holoubek et al. | 222/107 |
| 5,022,562 | A | | 6/1991 | Lurkis et al. | |
| 5,564,591 | A | | 10/1996 | Christine et al. | |
| 5,699,924 | A | * | 12/1997 | Mascio et al. | 215/252 |
| 5,810,185 | A | * | 9/1998 | Groesbeck | 215/387 |
| 5,813,575 | A | | 9/1998 | Glynn et al. | |
| 5,829,611 | A | * | 11/1998 | Beck | 215/252 |
| 5,971,182 | A | * | 10/1999 | Berge et al. | 215/252 |
| 5,975,369 | A | * | 11/1999 | Yurkewicz et al. | 222/153.06 |
| 6,000,578 | A | * | 12/1999 | Boissay | 222/83 |
| 6,000,848 | A | * | 12/1999 | Massioui | 383/80 |
| 6,079,589 | A | * | 6/2000 | Matsuyama et al. | 220/715 |
| 6,095,375 | A | * | 8/2000 | Adams et al. | 222/182 |
| 6,241,122 | B1 | * | 6/2001 | Araki et al. | 222/92 |
| 6,257,463 | B1 | | 7/2001 | De Polo | |

(Continued)

FOREIGN PATENT DOCUMENTS

JP 2000103454 A 4/2000

OTHER PUBLICATIONS

International Preliminary Report on Patentability (IPRP) for PCT/US2009/051774 issued by the IPEA/US on Feb. 28, 2011.

(Continued)

*Primary Examiner* — Kevin P Shaver
*Assistant Examiner* — Stephanie E Williams
(74) *Attorney, Agent, or Firm* — Arent Fox, LLP

(57) ABSTRACT

A re-sealable spigot includes a cylindrical structure configured to be attached to a liquid receptacle, wherein said cylindrical structure further comprises a stem, having an upper portion and a base portion, and a top in a coaxial arrangement with said upper portion of said stem, and a cap having a hollow receiving portion shaped as a multi-sided geometrical element, wherein said cap seals said cylindrical structure.

2 Claims, 3 Drawing Sheets

U.S. PATENT DOCUMENTS

| | | | | |
|---|---|---|---|---|
| 6,286,733 | B1 * | 9/2001 | Francois | 222/525 |
| 6,758,359 | B2 | 7/2004 | Yurkewicz et al. | |
| 6,805,261 | B1 | 10/2004 | Laudenberg | |
| 6,854,888 | B1 | 2/2005 | Brown et al. | |
| 6,874,664 | B1 * | 4/2005 | Montgomery | 222/525 |
| 7,066,360 | B2 * | 6/2006 | Hearld et al. | 222/525 |
| 7,661,560 | B2 * | 2/2010 | Murray | 222/107 |
| 2001/0027984 | A1 * | 10/2001 | Ichikawa | 222/464.3 |
| 2004/0155071 | A1 * | 8/2004 | Higgins | 222/525 |
| 2005/0092785 | A1 | 5/2005 | Hearld et al. | |
| 2005/0147329 | A1 * | 7/2005 | Arvizu | 383/104 |
| 2006/0138138 | A1 * | 6/2006 | Mishra | 220/270 |
| 2007/0025648 | A1 | 2/2007 | Micnerski et al. | |
| 2007/0133909 | A1 * | 6/2007 | Arvizu | 383/104 |
| 2007/0262100 | A1 | 11/2007 | Murray | |
| 2008/0185405 | A1 | 8/2008 | Murray et al. | |

OTHER PUBLICATIONS

Office Action for Chinese Patent Application No. 200980134434.8 issued by the State Intellectual Property Office on Feb. 20, 2012.

International Search Report and Written Opinion for PCT/US2009/051774 issued by the ISA/US on Sep. 4, 2009.

* cited by examiner

RE-SEALABLE SPIGOT FOR A COLLAPSIBLE BEVERAGE CONTAINER

BACKGROUND

1. Field

The present disclosure relates generally to beverage containers, and more particularly to a re-sealable spigot for collapsible beverage containers.

2. Background

Flexible containers made from paperboard or metal foil are often used to package various beverages for retail distribution. These flexible containers are often packaged with a separate straw wrapped in cellophane and secured to the outside of the container. The straw may be removed by the consumer and used to puncture a sealed spout as the straw is inserted into the container. Once the straw is inserted, the consumer may withdraw the beverage from the container.

The use of a straw secured to a beverage container has numerous drawbacks. Packaging a straw together with the container can be costly and inefficient, requiring not only an additional manufacturing step to make the straw and cellophane wrap, but yet another manufacturing step to wrap the straw with the cellophane and secure it to the container. When the consumer uses the straw, the cellophane wrap is discarded, resulting in waste. The insertion of the straw through the sealed spout into the container can also be difficult, and often results in the beverage squirting up through the spout. If the entire beverage is not consumed, then it will go to waste for there is no easy way to reseal the spout once it is punctured. Moreover, the straw is prone to dislodge from the container before use, making the consumption of the beverage very difficult, if not impossible.

Accordingly, there is a need for a re-sealable spigot for a collapsible beverage container that is commercially viable to produce for retail distribution. The beverage container should not require the use of a straw to consume the beverage and should have a mechanism to reseal the container in the event that the beverage is not completely consumed.

SUMMARY

One aspect of a re-sealable spigot is disclosed. A re-sealable spigot includes a cylindrical structure configured to be attached to a liquid receptacle, wherein said cylindrical structure further comprises a stem, having an upper portion and a base portion, and a top in a coaxial arrangement with said upper portion of said stem, and a cap having a hollow receiving portion shaped as a multi-sided geometrical element, wherein said cap seals said cylindrical structure.

Another aspect of a re-sealable spigot is disclosed. A re-sealable spigot includes a cylindrical structure configured to be attached to a liquid receptacle, comprising a stem, said stem having an upper portion and a base portion, and a top in a coaxial arrangement with said upper portion of said stem, and a multi-sided cap having a hollow receiving portion, wherein said cap temporarily seals said cylindrical structure.

It is understood that other embodiments of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION

The detailed description set forth below in connection with the appended drawings is intended as a description of various embodiments of the present invention and is not intended to represent the only embodiments in which the present invention may be practiced. Each embodiment described in this disclosure is provided merely as an example or illustration of the present invention, and should not necessarily be construed as preferred or advantageous over other embodiments.

Figure 1:
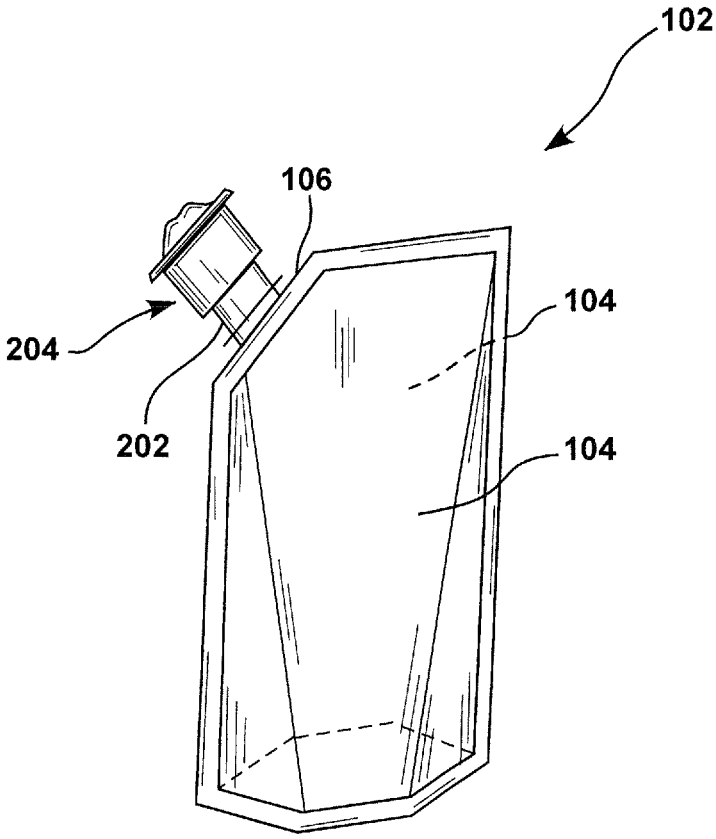
FIG. 1 is a perspective view showing a beverage container having a flexible stand-up pouch 102.

FIG. 1 is a perspective view showing a beverage container having a flexible stand-up pouch 102. The pouch may be constructed with two wall panels 104 with a corner section cut out at the top of the pouch 102 to form a slanted edge 106. A re-sealable spigot 200 (see FIG. 2) extending from the slanted edge 106 may be used by the consumer to dispense the beverage from the pouch 102. The term "re-sealable spigot" means a valve or spout, having a push-pull top 204, which moves up and down a stem 202 to open and close the spigot. By way of example, a push-pull top 204 shown, in FIG. 1 and FIG. 2, may be "pulled" up the stem 202 to open the spigot 200 and "pushed" down the stem 202 to close the spigot 200.

Figure 2:
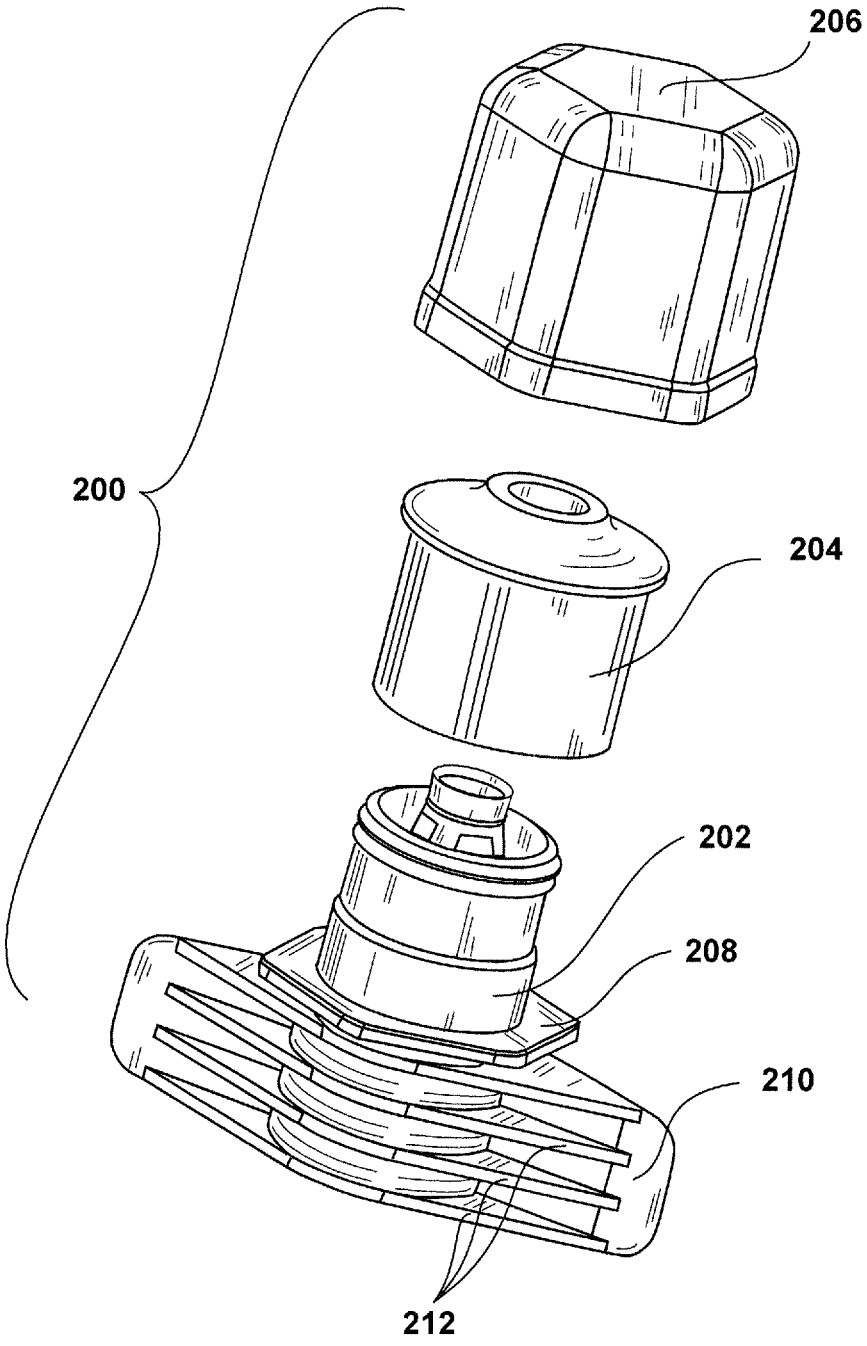
FIG. 2 is a perspective view of a re-sealable spigot and its individual components.

FIG. 2 is a perspective view of a re-sealable spigot 200 and its individual components. The individual components comprise: the stem 202, the push-pull top 204, and the sanitary cap 206. In at least one embodiment of the re-sealable spigot 200, the complete spigot 200 assembly may be formed with a tamper-evident seal. This may be achieved during the manufacturing process by heat-sealing the bottom portion of the sanitary cap 206 to the stem 202 with the re-sealable spigot 200 in the closed position. The tamper-evident seal may subsequently be broken by the consumer by simply twisting and/or pulling on the sanitary cap 206.

Since the physical dimensions of the pouch 102 may vary depending on manufacturing preferences and the particular application, the re-sealable spigot 200 may likewise having varying physical dimensions without straying from the teachings contained herein. For example, for retail distribution of beverage drinks, commercial viability may best be served with a small, lightweight construction. That is, the wall panels 104 may have a lateral height of 160 mm and a horizontal length of 110 mm. The slanted edge 106 may be formed at 45° angle for easy consumption of the beverage from the pouch 102 through the re-sealable spigot 200. Moreover, one of ordinary skill in the art may appreciate that the re-sealable spigot 200 may be configured onto the pouch 102 in countless arrangements.

Further, the lightweight construction of the beverage container may be achieved by selecting the appropriate material, and further facilitated by incorporating a disposable re-usable spigot 200. By way of example, the pouch 102 may be formed from a polyester, polyethylene laminate, wherein the attached re-sealable spigot 200 is comprised of a light polyurethane material capable of withstanding the repetitive open and close movements of the push-pull top 204. The polyethylene layer may provide a heat-sealable interior lining for the pouch 102. Because the polyester does not shrink during the heat-sealing process, various aesthetic features and written materials may be printed on the polyester layer before the pouch 102 is constructed without experiencing distortion during the heat-sealing process. The thickness of the polyester film may be about 12 microns and the thickness of the polyethylene may be about 90 microns. Other material thicknesses may be used where appropriate.

By way of the stem 202, the re-sealable spigot 200 may be fused between the wall panels 104 during the manufacturing process. Upon heat treatment, the wall panels 104 form around the canoe portion 210 of the stem 202. The canoe portion 210 may have one or more horizontal ribs 212 that may provide sufficient friction and resistance so as to create a hermetically sealed pouch 102 prior to receiving a liquid for subsequent dispensing. The push-pull top 204 may be separately formed and placed over the stem 202 since the substantially hollow cylindrical structure of the push-pull top 204 may receive the stem 202 via a friction fit. The sanitary cup 206 may be removed and replaced as necessary to extract the liquid found within the pouch 102, thus, protecting the push-pull top 204 from foreign particulate matter or other unsanitary debris. As illustrated, the sanitary cup 206 may comprise a hollow hexagon shape that may receive the push-pull top 204 in its closed position and latch onto the stem 202 at a hexagonal receiving portion 208. The hexagonal receiving portion 208 may be manufactured in such a way so as to form a snap fit within the inside perimeter of the sanitary cap 206. As one of ordinary skill in the art may appreciate, although a hexagon is shown in the depicted illustrations, one may easily replace the base shape with any multi-sided polygon having three or more sides and likewise come within the spirit and objectives of this disclosure.

Figure 3:
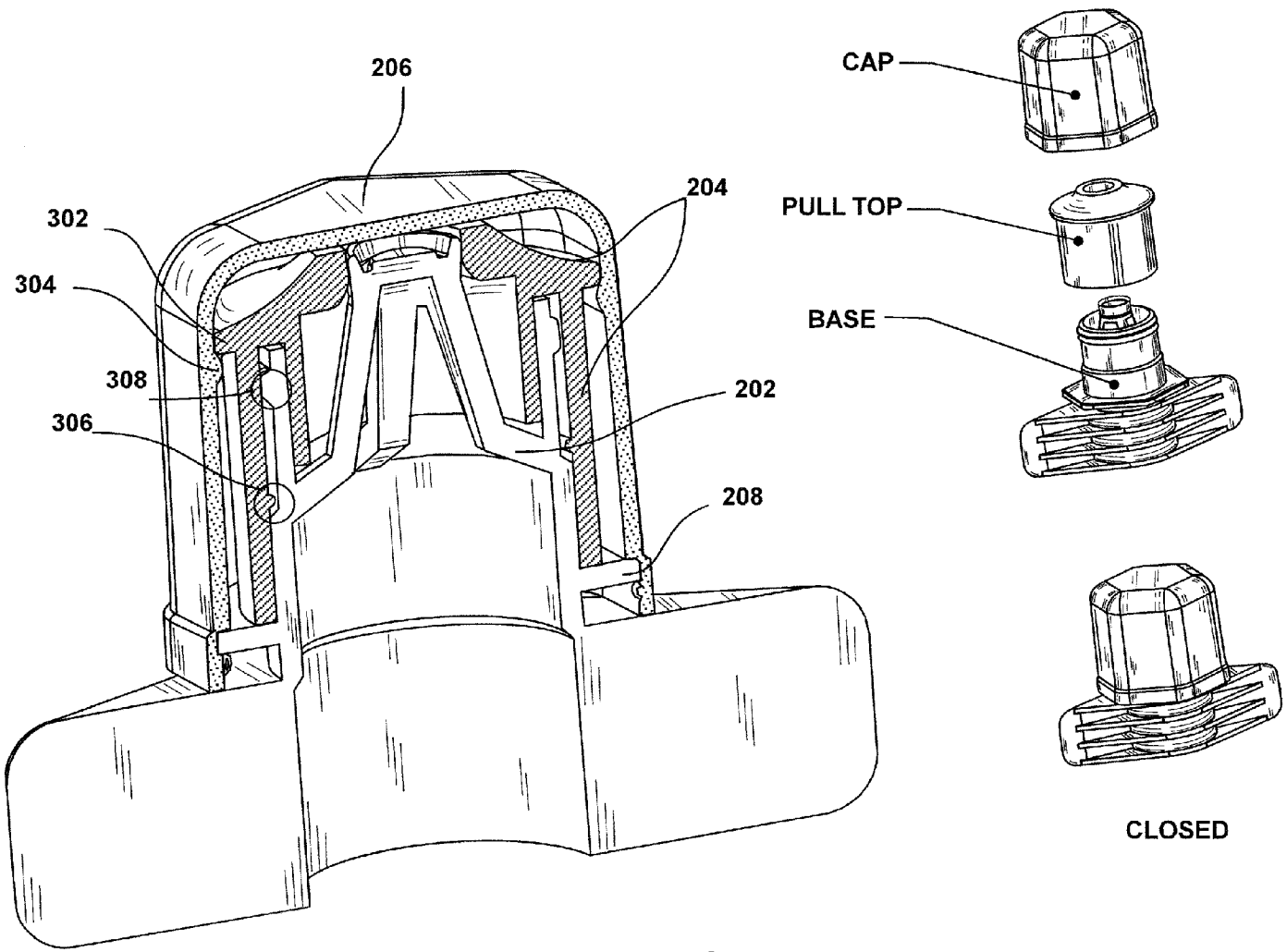
FIG. 3 is a cross section of a re-sealable spigot in the sealed position.

FIG. 3 is a cross section of a re-sealable spigot 200 in the sealed position with the sanitary cap 206 in place. The cylindrical stem 202 may have a barrier flange 308 that extends around the circumference of the stem 202 and protrude away from its longitudinal axis. The push-pull top 204 may likewise have an inwardly extending catch flange 306 around the internal circumference of the top 204. The catch flange 306 and barrier flange 308 facilitate the ability of the push-pull top 204 to travel along the stem 202 axis without inadvertent removal and further, allows the top 204 to temporarily lock in the closed position to prevent inadvertent liquid spills.

Similarly, the sanitary cap 206 may contain a flange 304 that extends the entire inside circumference of the sanitary cap 206. The push-pull top 204 may have a lip 302 at the upper most portion of the top 204 that provides for the interlocking with the flange 304 when a places the cap 206 over the push-pull top 204 and exerts a downward force upon the cap 206 so as to temporarily seal the drinking portion of the re-sealable spigot 200. In reversing this process, a user may be able to exert an upward force upon the sanitary cap 206 to remove the cap and expose the push-pull top 204 for liquid extraction. The range of force necessary for placing and removing the cap 206 will vary depending on the size and placement of the interlocking flange structures 304 and 302.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A re-sealable spigot for a liquid receptacle, comprising:

a cylindrical structure configured to be attached to a liquid receptacle, wherein said cylindrical structure further comprises a canoe for attaching said spigot to said liquid receptacle, said canoe having a shoulder, a stem extending from said canoe, said stem having a first flange, and a top in a coaxial arrangement with said stem, said top movable between open and closed positions, wherein said first flange extends around the external circumference of said stem and protrudes outwardly along said longitudinal axis a cap having a hollow receiving portion shaped as a multi-sided geometrical element, wherein said cap forms a snap-fit seal with said first flange and abuts said shoulder when said spigot is resealed, and a tamper-evident seal between said multi-sided cap and said stem when said cap is in a sealed position wherein said first flange of said stem comprises the identical shape of said multi-sided geometrical element and is configured to enter said cap so as to protect said cylindrical structure, wherein said top has a second flange, wherein said second flange extends around the internal circumference of said top and protrudes inwardly along a longitudinal axis thereof and wherein said second flange is configured to facilitate a push-pull function of said top, wherein said cap further comprises a third flange extending around the internal circumference of said cap and protruding inwardly along a longitudinal axis so as to engage with said first flange of said top to form said seal with said cap when said stem is in said closed position.

2. A re-sealable spigot for a liquid receptacle, comprising:

a cylindrical structure configured to be attached to a liquid receptacle, comprising a canoe for attaching said spigot to said liquid receptacle, a stem extending from said canoe, said canoe having a shoulder, said stem having a first flange, and a top in a coaxial arrangement with said stem, said top movable between open and closed positions, wherein said first flange extends around said external circumference of said stem and protrudes outwardly along said longitudinal axis;

a re-sealable multi-sided cap having a hollow receiving portion, wherein said cap forms a re-sealable seal with said first flange and abuts said canoe shoulder when said spigot is resealed, and a tamper-evident seal between said multi-sided cap and said stem when said cap is in a sealed position, wherein said first flange of said stem comprises the identical multi-sided shape of said multi-sided cap and is further configured to enter said multi-sided cap, wherein said top has a second flange, wherein said second flange extends around the internal circumference of said top and protrudes inwardly along a longitudinal axis thereof and wherein said second flange is configured to facilitate a push-pull function of said top, and wherein said multi-sided cap further comprises a third flange extending around the internal circumference of said multisided cap and protruding inwardly along a longitudinal axis so as to engage with said first flange of said stem to form said re-sealable seal with said cap when said top is in said closed position.

* * * * *